US009945011B2

(12) United States Patent
Venkatesan et al.

(10) Patent No.: US 9,945,011 B2
(45) Date of Patent: Apr. 17, 2018

(54) MAGNESIUM-BASED ALLOY FOR WROUGHT APPLICATIONS

(75) Inventors: Kishore Venkatesan, Berwick (AU); Wendy Elizabeth Borbidge, Hawthorn (AU); Michael Edward Kellam, Glen Waverley (AU); Daniel Liang, Rowville (AU); Peter Adrian Lynch, Northcote (AU); Guangsheng Song, Springvale (AU)

(73) Assignee: Commonwealth Scientific and Industrial Research Organisation, Campbell, Astralian Capital Territory (AU)

( * ) Notice: Subject to any disclaimer, the term of this patent is extended or adjusted under 35 U.S.C. 154(b) by 0 days.

(21) Appl. No.: 13/699,402

(22) PCT Filed: May 24, 2011

(86) PCT No.: PCT/AU2011/000611

§ 371 (c)(1),
(2), (4) Date: Mar. 29, 2013

(87) PCT Pub. No.: WO2011/146970

PCT Pub. Date: Dec. 1, 2011

(65) Prior Publication Data

US 2013/0199677 A1 Aug. 8, 2013

(30) Foreign Application Priority Data

May 24, 2010 (AU) ..... 2010-902247

(51) Int. Cl.

| | |
|---|---|
| ***C22C 23/06*** | (2006.01) |
| ***B22D 21/00*** | (2006.01) |
| ***C22C 23/04*** | (2006.01) |
| ***C22F 1/06*** | (2006.01) |

(52) U.S. Cl.

CPC ..... *C22C 23/06* (2013.01); *B22D 21/007* (2013.01); *C22C 23/04* (2013.01); *C22F 1/06* (2013.01)

(58) Field of Classification Search

CPC ..... C22C 23/00; C22C 23/04; C22C 23/06
USPC ..... 420/400, 402, 405, 406, 407, 408, 411, 420/414, 415, 443, 455, 511, 532, 541, 420/556, 557, 562, 900; 148/102, 404, 148/420, 426, 429, 437, 538, 555, 557
See application file for complete search history.

(56) References Cited

U.S. PATENT DOCUMENTS

| | | | | |
|---|---|---|---|---|
| 5,326,528 | A | 7/1994 | Makino et al. | |
| 2006/0231169 | A1 * | 10/2006 | Park et al. | 148/403 |

FOREIGN PATENT DOCUMENTS

| | | | | |
|---|---|---|---|---|
| CN | 1851020 | A | 10/2006 | |
| CN | 101190491 | A | 6/2008 | |
| CN | 101429611 | A | 5/2009 | |
| DE | 19915238 | A1 * | 10/2000 | C22C 23/00 |
| GB | 794474 | A | 5/1958 | |
| JP | 6-293944 | | 10/1994 | |
| JP | 7-126790 | | 5/1995 | |
| JP | 08-134581 | A | 5/1996 | |
| JP | 2006-513864 | | 4/2006 | |
| JP | 2007-169756 | | 7/2007 | |
| JP | 2008-156725 | | 7/2008 | |
| JP | 2008156725 | A * | 7/2008 | |
| JP | 2010-13725 | | 1/2010 | |
| WO | WO 2009/086585 | A1 | 7/2009 | |

OTHER PUBLICATIONS

NPL-1 Liu, Yong, et al. "Microstructure and mechanical properties of Mg—Zn—Gd-based alloys strengthened with quasicrystal and Laves phase." Transactions of Nonferrous Metals Society of China 17.s1A (2007): s353-s357.*

English Machine Translation of JP 2008156725 A of Kamatsuchi, Shigeharu et al. published Jul. 10, 2008.*

English Machine Translation of JP 06293944 A of Sekiguchi, Shoichi et al. published Oct. 21, 1994.*

L. Qi-chi, Z. Zhi-qiang, S. Zhi-wen, C. Jian-zhong, X. Yi, Microstructures and mechanical properties of Mg-2%Zn-0.4%RE alloys, Trans. Nonferrous Met. Soc. China, 20 (2010), pp. s352-s356.*

International Search Report, dated Jun. 22, 2011 in connection with PCT International Application No. PCT/AU2011/000611, filed May 24, 2011.

Written Opinion of the International Searching Authority, dated Jun. 22, 2011 in connection with PCT International Application No. PCT/AU2011/000611, filed May 24, 2011.

Japanese official action (English language translation thereof) dated Mar. 23, 2015 in connection with Chinese Patent Application No. 2013-511479.

Yong Liu, et al. Effects of Zn/Gd Ration and Content of Zn, Gd on Phase Constitutions of Mg Alloy. *Materials Transactions*, vol. 49, No. 5, pp. 941 to 944.

(Continued)

*Primary Examiner* — Roy V King
*Assistant Examiner* — Jophy S. Koshy
(74) *Attorney, Agent, or Firm* — Brinks Gilson & Lione

(57) ABSTRACT

An improved magnesium-based alloy for wrought applications is disclosed, including a method of fabricating alloy sheet from said alloy. The improved magnesium-based alloy consists of: 0.5 to 4.0% by weight zinc; 0.02 to 0.70% by weight a rare earth element, or mixture of the same including gadolinium; and incidental impurities. The rare earth element in some embodiments may be yttrium and/or gadolinium. In some embodiments the magnesium-based alloy may also consist of a grain refiner and in some embodiments the grain refiner may be zirconium. In combination, the inclusion of zinc and a rare earth element, into the magnesium alloy may have enhanced capacity for rolling workability, deep drawing at low temperatures and stretch formability at room temperature. The improved alloy may also exhibit increased tensile strength and formability while evincing a reduced tendency for tearing during preparation.

3 Claims, 5 Drawing Sheets

(56) References Cited

OTHER PUBLICATIONS

Fu, D. et al. (2006) The Effect of Annealing on Microstructure and Mechanical Properties of Rolled AZ31 Magnesium Alloy. *Special Casting & Nonferrous Alloys*, Issue 10, pp. 661-663.
May 6, 2014 Chinese official action in connection with corresponding Chinese Patent Application No. 201180025024.7.

* cited by examiner

MAGNESIUM-BASED ALLOY FOR WROUGHT APPLICATIONS

CROSS-REFERENCE TO RELATED APPLICATIONS

This application is a § 371 national stage of PCT International Application No. PCT/AU2011/000611, filed May 24, 2011, claiming priority of Australian Patent Application No. 2010902247, filed May 24, 2010, the contents of each of which are hereby incorporated by reference in their entirety.

TECHNICAL FIELD

This invention concerns an improved wrought magnesium alloy. The application of the present invention further concerns a method of fabricating a magnesium-based alloy sheet product. The invention has particular application to the production of sheets for automotive application and electronic enclosures.

BACKGROUND

Magnesium alloys are considered to be amongst the advanced materials of the 21$^{st}$ century. Not only are they lightweight (with a density that is approximately two thirds that of aluminium), they have the benefits of high specific strength, stiffness and dent resistance, good damping characteristics and excellent castability. They are particularly attractive for electronics, space and defence applications.

In recent years, the use of wrought magnesium alloy sheet has experienced significant growth in the areas of electronic device enclosures and batteries. Furthermore the United States Council for Automotive Research has initiated research programs to demonstrate the application of wrought magnesium alloy in automobiles. Identified products suitable for manufacture from wrought magnesium alloys include inner panel components, covers, chassis parts and bumper reinforcements.

Typically, a quantity of the alloy is produced into a sheet which can then be shaped to form the desired product using different forming technologies for sheet products, such technologies include blanking, bending, sheet stamping and cup drawing (deep drawing). In conventional production of magnesium alloy sheet via direct-chill (DC) slab casting, the magnesium alloy is supplied as slabs typically 300 mm by 1 m in cross-section and 2 m to 6 m long. These slabs are first homogenized or preheated (for example at 480° C. for AZ31) for several hours and then continuously hot rolled on a reversing hot mill until reduced to about 5 to 6 mm thick. The sheet metal is re-heated at 340° C. before each pass of ~20% reduction in the final finish mill. New improved production techniques like twin-roll casting (TRC), enables the production of sheets of magnesium alloy direct from molten metal with a thickness less than 10 mm, eliminating the need for much of the repeated rolling, re-heating and sometimes intermediate annealing used in conventional sheet manufacturing methods.

Magnesium, with its hexagonal close packed (HCP) crystal structure, has very limited number of slip systems operable at room temperature for successful rolling. Hence, temperatures between 250° C. to 450° C. are used for rolling a magnesium alloy. Although a wide range of temperatures is used, manufacturers of alloy sheet desire alloys which are suitable for rolling at reasonably low temperatures.

A wrought magnesium alloy that is widely available for sheet metal forming is the alloy designated AZ31B. The nominal composition by weight of this alloy is about three percent aluminium, one percent zinc, controlled and limited amounts of impurities, and the balance magnesium. Common problems that restrict the use of wrought magnesium alloy materials such as AZ31B are the initial cost of the magnesium sheet material associated with existing commercial production techniques and its reduced formability and workability at relatively lower temperatures compared to conventional materials such as aluminium. As such, there is a need to develop new wrought magnesium alloys that have good ductility, formability and workability at lower temperatures and more suitable for commercial use.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

SUMMARY

Some embodiments concern a magnesium-based alloy for wrought applications consisting of: 0.5 to 4.0% by weight zinc, 0.02 to 0.70% by weight a rare earth element or mixture of the same; and the remainder being magnesium except for incidental impurities.

The magnesium-based alloy may comprise around 1.0 to around 4.0% by weight Zinc, optionally about 1.0 to about 3.0% by weight zinc, optionally about 1.0 to about 2.5% by weight zinc.

The magnesium-based alloy may comprise 0.10% to 0.65% by weight rare earth element or mixture thereof.

The rare earth component may comprise a rare earth element of the lanthanide series or yttrium. For the purposes of this specification the lanthanide elements comprise the group of elements with an atomic number including and increasing from 57 (lanthanum) to 71 (lutetium). Such elements are termed lanthanide because the lighter elements in the series are chemically similar to lanthanum. Strictly speaking lanthanum is a group 3 element and the ion $La^{3+}$ has no f electrons. However lanthanum is often included in any general discussion of the chemistry of the lanthanide elements. Therefore the rare earth elements of the lanthanide series comprise: lanthanum, cerium, praseodymium, neodymium, promethium, samarium, europium, gadolinium, terbium, dysprosium, holmium, erbium, thulium, ytterbium and lutetium. For present purposes, yttrium will be considered to be encompassed by the term "rare earth element".

In some embodiments, the rare earth component comprises gadolinium. In some embodiments, the rare earth component comprises yttrium. An advantage of an embodiment comprising a rare earth element of the lanthanide series or yttrium is their relatively high solubility in magnesium.

The incidental impurities may comprise Li, Be, Ca, Sr, Ba, Sc, Ti, Hf, Mn, Fe, Cu, Ag, Ni, Cd, Al, Si, Ge, Sn, and Th, alone, or in combination, in varying amounts.

The magnesium-based alloy may comprise incidental impurities having less than 0.5% by weight. The magnesium-based alloy may comprise incidental impurities having less than 0.2% by weight. The magnesium-based alloy may comprise incidental impurities having less than 0.1% by weight.

The alloy compositions in accordance with described embodiments may have enhanced capacity for rolling workability, deep drawing at low temperatures and good stretch formability at room temperature. The alloy compositions may also show a reduced tendency for tearing during preparation.

Some embodiments relate to a magnesium-based alloy for wrought applications consisting of: 0.5 to 4.0% by weight zinc, 0.02 to 0.70% by weight a rare earth element or mixture of the same including gadolinium, 0.2 to 1.0% by weight a grain refiner and the remainder being magnesium except for incidental impurities.

The grain refiner may include, but not be limited to, zirconium. By using zirconium, improved or similar properties can be achieved.

Some embodiments relate to a magnesium-based alloy for wrought applications consisting of: 0.5 to 4.0% by weight zinc, 0.02 to 0.70% by weight yttrium or a mixture of yttrium with a rare earth element; and the remainder being magnesium except for incidental impurities.

Some embodiments relate to a magnesium-based alloy for wrought applications consisting of: 0.5 to 4.0% by weight zinc, 0.02 to 0.70% by weight yttrium or a mixture of yttrium with a rare earth element, 0.2 to 1.0% by weight a grain refiner and the remainder being magnesium except for incidental impurities. The grain refiner may include zirconium.

The magnesium-based alloy may comprise 1.0 to 3.0% by weight zinc. Optionally, the magnesium-based alloy comprises 1.0 to 2.5% by weight zinc. The magnesium-based alloy comprises 0.10% to 0.65% by weight rare earth element or mixture thereof.

The rare earth element mixture may comprise yttrium and a rare earth element of the lanthanide series or gadolinium. Alternatively, the rare earth element or mixture may consist essentially of yttrium.

The magnesium-based alloy comprises incidental impurities having less than about 0.5% by weight, optionally less than about 0.2% by weight.

Embodiments further concern a method of fabricating a magnesium-based alloy sheet product, the method comprising:

a) providing an magnesium alloy melt from the magnesium-based alloys of any of the described embodiments;
b) casting said magnesium alloy melt into a slab or a strip according to a predetermined thickness;
c) homogenising or preheating said cast slab or strip;
d) successively hot rolling said homogenised or preheated slab or strip at a suitable temperature to reduce said thickness of said homogenised slab or strip to produce an alloy sheet product of a predetermined thickness; and
e) annealing said alloy sheet product at a suitable temperature for a period of time.

The magnesium alloy melt may comprise essentially in weight percent, 0.5 to 4.0 zinc (optionally about 1.0 to about 4.0% by weight Zinc, optionally about 1.0 to about 3.0% and optionally about 1.0 to about 2.5%), 0.02 to 0.70% by weight a rare earth element (optionally about 0.1 to about 0.65%); and the remainder being magnesium except for incidental impurities. The rare earth component may comprise a rare earth element of the lanthanide series or yttrium or mixtures of the same. In some embodiments, the rare earth component comprises gadolinium. In some embodiments, the rare earth component comprises yttrium. The alloy may further comprise a grain refiner, including, but not limited to zirconium.

The method may further comprise forming said magnesium alloy melt by melting requisite quantities of Mg, Zn and the rare earth element.

The step of casting said magnesium alloy melt into a slab or a strip may comprise feeding said magnesium alloy melt between rolls of a twin-roll caster. The magnesium alloy melt may be fed between rolls of the caster at a temperature of about 700° C.

Alternatively, the step of casting said magnesium alloy melt into a slab or a strip may comprise pouring said magnesium alloy melt into a DC caster (semicontinuous casting) or a strand caster (continuous casting).

The step of casting a magnesium alloy slab or a strip may also include the use of a DC cast billet which is subsequently extruded to form a slab or strip after necessary preheating.

The step of, homogenising or preheating said cast slab may occur at a temperature of between 300° C. to 500° C. Depending on the casting technique used, the homogenising or preheating temperature will vary. For instance, for DC casting, temperatures in the range 450° C. to 500° C. would be suitable. For TRC temperature in the range 335° C. to 345° C. would be preferable.

In general, the step of homogenising or preheating said cast slab or strip is carried out for a period of about 0.25 to 24 hours.

The step of successively hot rolling said homogenised slab or strip may occur with break-down rolling. Such a step may be appropriate with cast slabs having a thickness greater than 25 mm in order to reduce the thickness down to about 5 to 6 mm at a temperature between 450° C. to 500° C. Subsequent rolling to a lesser required thickness may be performed at a lower temperature between 250° C. and 450° C. TRC strips for instance may be rolled at a temperature between 250° C. and 450° C. The step of successively hot rolling said homogenised slab or strip may comprise reducing the thickness of the homogenised slab or strip to required thickness for specific application.

Optionally, the step of successively hot rolling said homogenised slab or strip may occur without break-down rolling.

The temperature for annealing is dependent on parameters including the composition of the alloy and the amount of deformation, etc. The temperature may vary for each alloy and process steps. Preferably the annealing temperature is ±50° C. from the inflection point of an annealing curve obtained for a standard period of 1 hour. The period of time to anneal said alloy sheet product may be approximately 0.25-24 hours.

Further aspects of the embodiments will become apparent from the following description given by way of example only and with reference to the accompanying drawings.

BRIEF DESCRIPTION OF THE DRAWINGS

In order that the embodiments may more readily be understood, reference now is directed to the accompanying drawings, in which.

DETAILED DESCRIPTION

Figure 1:
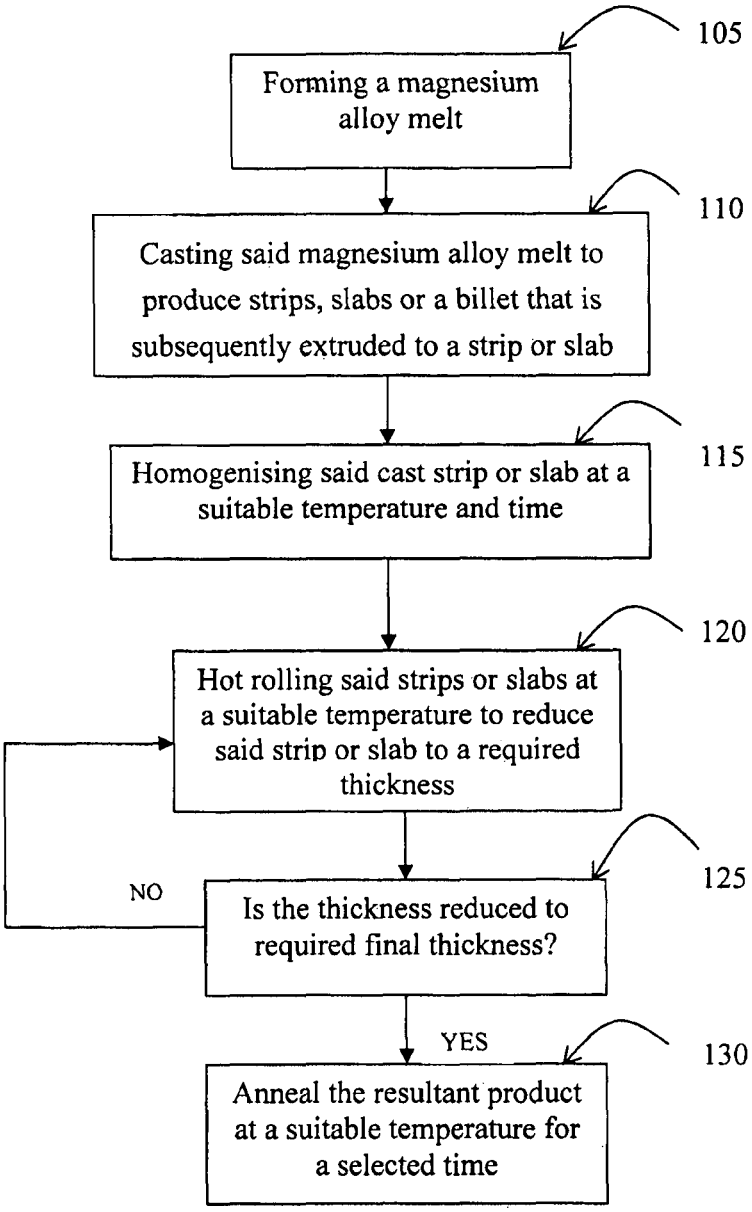
FIG. 1 is a flow chart depicting a method of fabricating a magnesium alloy sheet product in accordance with the invention.

The Mg—Zn based alloy system is considered a suitable candidate for wrought alloy development because both the strength and ductility of the alloy can be increased by increasing the zinc content up to a certain amount. Ductility of the Mg—Zn system will increase with zinc until a maximum of 3 wt % is reached, and starts to decrease with further increase in zinc content. However, the strength of the alloy will increase until a maximum of 6 wt % is reached.

As per the Mg—Zn binary phase diagram of Reference 5, the amount of zinc in solid solution at 340° C. is 6.2 wt % and at room temperature is close to 1.8 wt %. An alloy containing zinc above 1.5 wt % will start to form second phase along the grain boundary, the extent of which will increase with increasing zinc content.

The small grain size achieved by the TRC process and the small amount of second phase formed with zinc contents below 3 wt %, allow the sheet to be rolled easily. The small grain size can be achieved by the addition of zirconium to a DC cast billet.

Although alloys containing zinc above 3 wt % can be cast via the Twin-Roll Casting or DC casting route, the amount of second phase formed along the grain boundary will be much higher. This alloy will require longer homogenisation time to take the grain boundary phase into solution. Further the higher zinc content will reduce the ductility of the alloy. For such an alloy to be successfully hot rolled, the percentage reduction per pass will have to be in the range of 10-15% compared to 30-35% achieved for alloys containing zinc below 3 wt %. This will increase the number of roll passes required to achieve the final thickness for an alloy containing zinc above 3 wt % compared to an alloy with zinc below 3 wt %, thus making the system economically less attractive.

The magnesium alloy of described embodiments was formed by melting requisite quantities of Mg, Zn and a rare earth element. Two embodiments of the alloy in accordance with the invention were formed comprising Magnesium, Zn and master alloys of yttrium or gadolinium (Mg with 27 wt. % Y and Mg with 40 wt. % Gd master alloys for example but not restricted to), respectively, in appropriate amounts were added in an 80 kg furnace (with about 10 to 15% excess amount of rare-earth element to account for losses) to make up 50 kg of the alloy. In each case, the purity of the Mg component is about 99.95%, whereas the purity of the zinc component is about 99.9%. The alloy formed is suitable for magnesium billet, sheet or slab production as well as extrusion to form a desired shape.

FIG. 1 illustrates a flow chart depicting a method of fabricating a magnesium alloy sheet. At step 105 a magnesium alloy melt is provided according to the composition described herein.

At step 110, the respective alloys were cast using TRC or by sand casting with chill plates on the two faces of the casting to provide a faster cooling rate. Sand casting, whilst not used extensively in commercial applications, is capable of simulating the effects which would be derived from continuous and semi-continuous casting like direct chill (DC) casting. Alternatively, any other casting processes like DC casting may be used for this step. DC casting can be performed as described in any of references 1 to 3, the contents of which are incorporated herein by reference in their entirety. The strip or slab could also be made from a DC cast billet which has been subsequently extruded to a slab or strip such as described in reference 4, the contents of which are incorporated herein by reference in its entirety.

In one embodiment alloys were cast using TRC to produce strips approximately 150 mm wide and with two different thicknesses: 3.00 mm and 4.35 mm. It should be noted that the alloy can be cast wider using TRC depending on the size of the commercial TRC machine. The method of TRC of magnesium alloys as substantially described in PCT/AU2003/001097, assigned to the Commonwealth Scientific and Industrial Research Organisation, and incorporated herein by reference in its entirety. In an alternative embodiment, alloys were cast using sand casting to provide slabs approximately 195 mm in length, 115 mm wide and 29 mm thick.

At step 115, the cast strip or slab is homogenised, or preheated, at a selected temperature and for a selected period of time. Homogenisation or preheating is employed to reduce the interdendritic segregation and compositional differences associated with the casting process. A suitable commercial practice is to choose a temperature, usually 5 to 10° C., below the non-equilibrium solidus. Given that magnesium and zinc are the major constituents in the alloys, a temperature range of 335° C. to 345° C. (±5° C.) is preferable. For the present examples a temperature of approximately 345° C. (±5° C.) was chosen from the Mg—Zn binary phase diagram depicted in reference 5. For DC casting generally temperatures between 450° C. to 500° C. are commonly used. The time required for the homogenisation step is dictated by the size of the cast strip or slab. For TRC strip a time of 2 to 4 hrs is sufficient, while for sand cast slab or direct-chill cast slab up to 24 hrs will be required.

The homogenised strips or slabs were hot rolled at a suitable temperature, step 120. The rolls themselves are generally warm with temperatures of 80° C. to 120° C., however cold rolls may also be used. Depending on the cast material different rolling steps are used. For alloy slabs with a thickness above 25 mm produced by sand casting, DC casting or any other type of casting, a break-down rolling step is used. Techniques described in either of references 1 or 6 may be employed. The content of reference 6 is incorporated herein by reference in its entirety. The aim of this step is to reduce the thickness, as well as to refine and remove the cast structure. The temperature for this step is dependent on the furnace available at the rolling facility, but usually a temperature between 450 to 500° C. is employed.

Once a thickness of 5 mm or lower is reached, rolling is performed at a temperature between 250° C. to 450° C. For alloy strips produced by TRC, rolling is performed at a temperature between 250° C. to 450° C. without the need of a break-down rolling step. After each pass the strip or slab may be re-heated for about 10 to 15 minutes to bring the temperature up before the next pass. A few cold passes with a percentage reduction per pass of 10% may also be used as a final rolling or sizing operation. This process is continued until the final thickness (within the set tolerances) is achieved, at step 125.

At step 130, the hot rolled sheets were then annealed at a suitable temperature and time. Annealing is a heat treatment process designed to restore the ductility to an alloy that has been severely strain-hardened by rolling. There are three stages to an annealing heat treatment—recovery, re-crystallisation and grain growth. During recovery the physical properties of the alloy like electrical conductivity is restored, while during recrystallisation the cold worked structure is replaced by new set of strain-free grains. Recrystallisation can be recognised by metallographic methods and confirmed by a decrease in hardness or strength and an increase in ductility. Grain growth will occur if the new strain-free grains are heated at a temperature above that required for recrystallisation resulting in significant reduction in strength and should be avoided. Recrystallisation temperature is dependent on the alloy composition, initial grain size and amount of prior deformation among others; hence, it is not a fixed temperature. For practical purposes, it may be defined as the temperature at which a highly strain-hardened (cold worked) alloy recrystallises completely in 1 hour.

Figure 3:
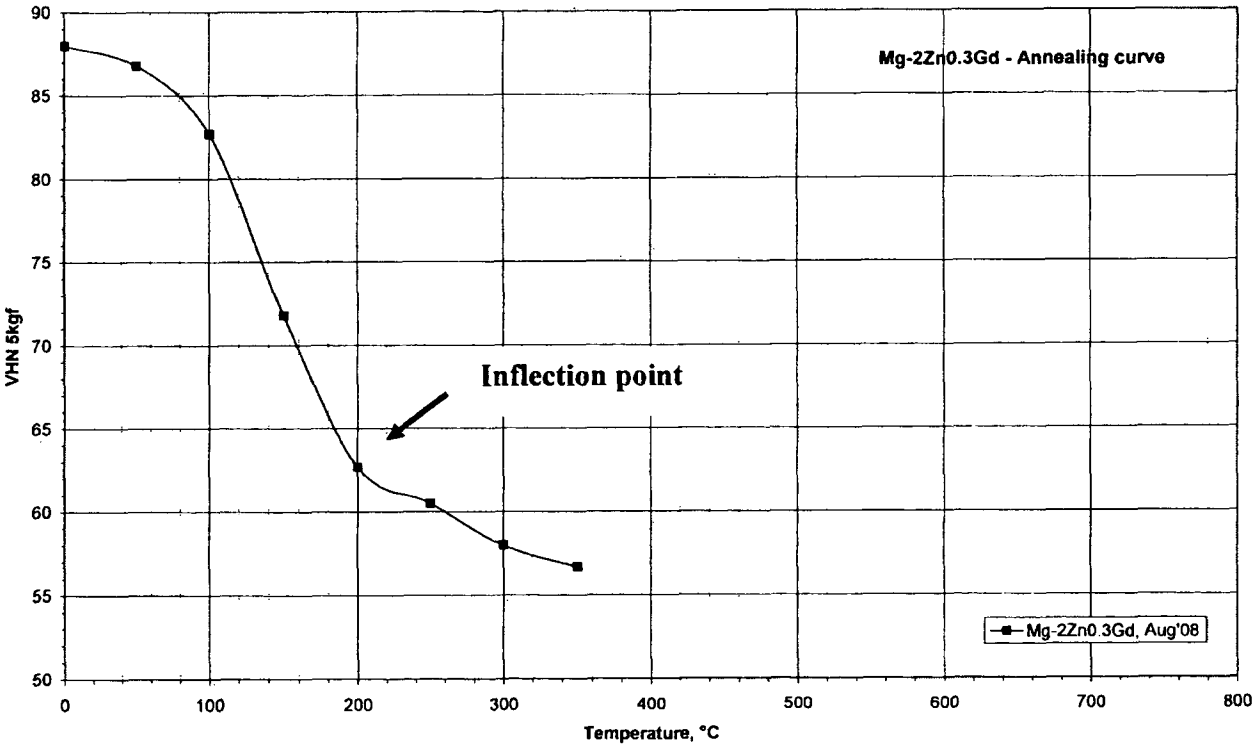
FIG. 3 is a graph identifying the inflection point of the hardness-annealing temperature curve for Mg-2Zn-0.3Gd cast by TRC.
Figure 4:
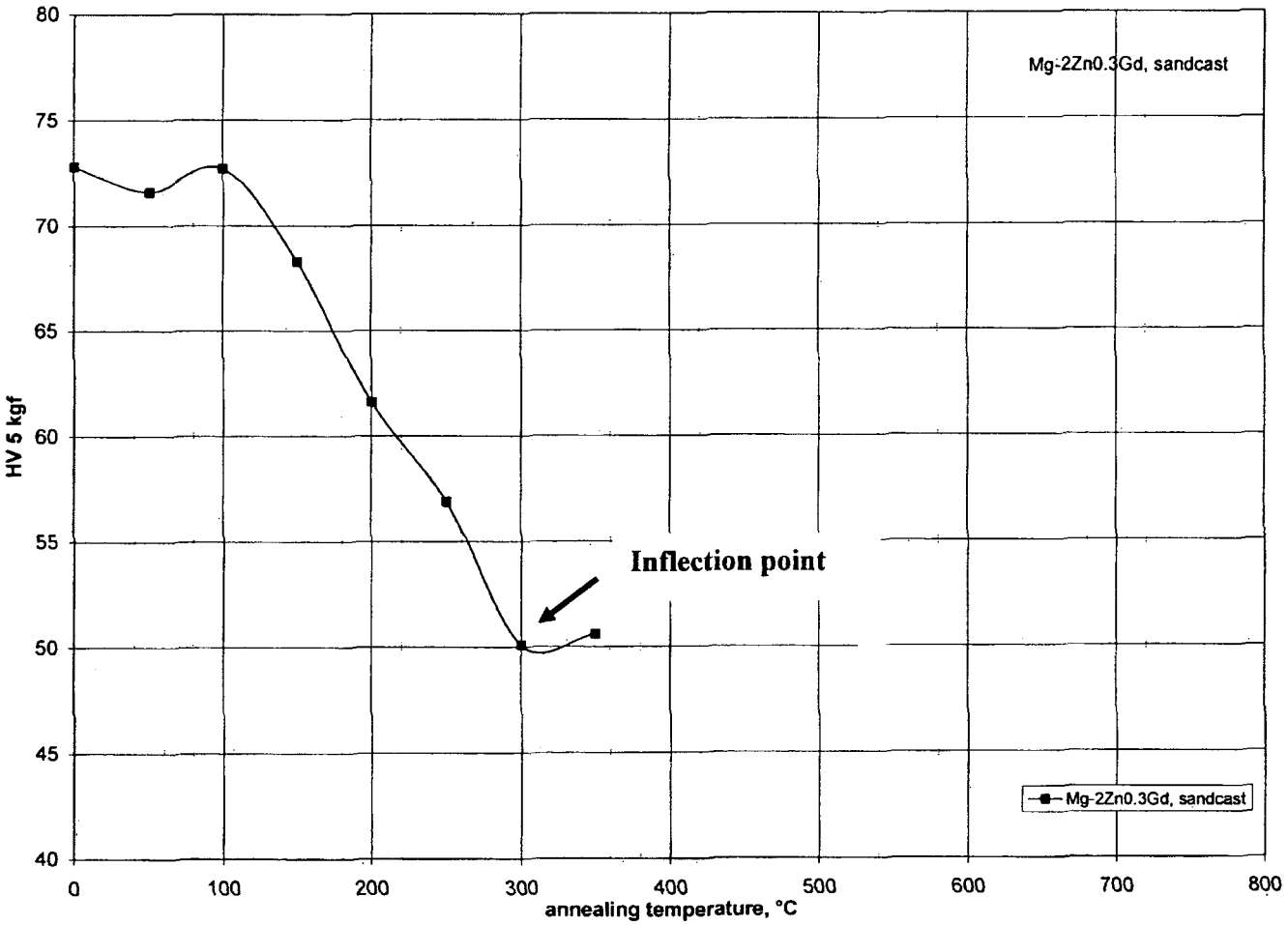
FIG. 4 is a graph identifying the inflection point of the hardness-annealing temperature curve for Mg-2Zn-0.3Gd cast by sand casting.
Figure 5:
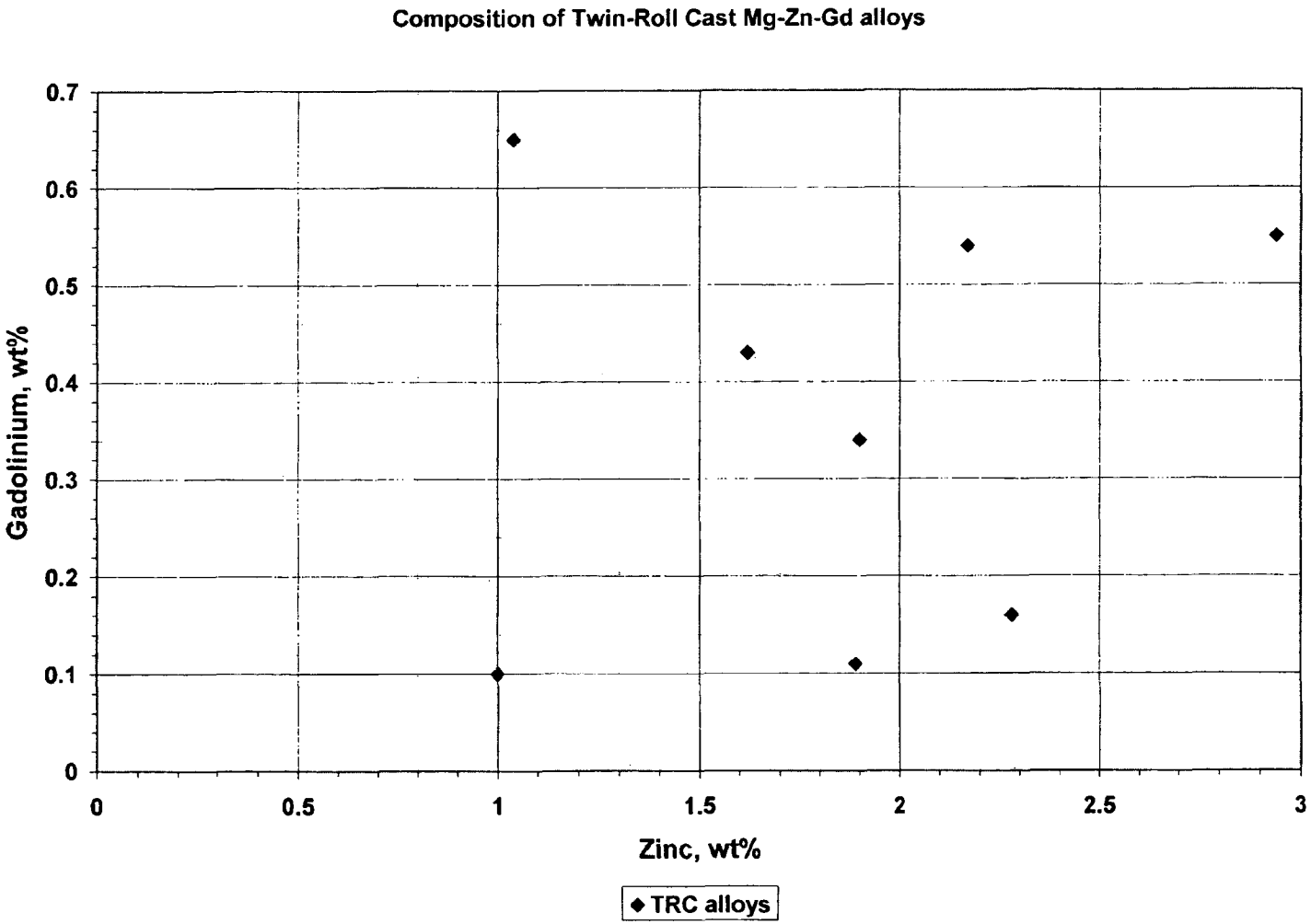
FIG. 5 is a graph identifying the composition of various test samples of Mg—Zn—Gd alloys, cast by TRC.

The optimum annealing temperature for each alloy and condition is identified by measuring the hardness after exposing the alloy at different temperatures for 1 hr, and establishing an annealing curve to identify the approximate temperature at which re-crystallisation ends and grain growth begins. This temperature may also be identified as the inflection point of the hardness-annealing temperature curve, as described in reference 7, the content of which is incorporated herein by reference in its entirety. Although this technique is used for non-ferrous alloys, this has not been applied before to hot rolled magnesium alloys. In order to ascertain the most suitable annealing temperature this technique was used for the present investigation. Accordingly, approximate annealing temperature for each magnesium alloy was chosen using an annealing curve as demonstrated in the examples which follow and with reference to FIGS. 2 to 4. This technique allows achieving the optimum temperature easily and reasonably accurately.

Thereafter, the annealed strips were quenched in a suitable medium.

A series of experiments were undertaken to test the relative merit of the described alloy embodiments, and to establish the low temperature formability of the alloys having been fabricated to form a sheet product.

Two examples of the alloy in accordance with the embodiments were tested. In the first embodiment the rare earth component was yttrium. The alloy contained 2.0% by weight zinc, 0.3% by weight of yttrium (nominal compositions) with the remainder being magnesium. This alloy is referred to as Mg-2Zn-0.3Y. In the second embodiment the rare earth component was gadolinium. This alloy contained 2.0% by weight zinc, 0.3% by weight of gadolinium (nominal compositions) with the remainder being magnesium. This alloy is referred to as Mg-2Zn-0.3Gd. Conventional AZ31B was further tested. In addition comparisons were referenced against existing alloys: Mg-1.5Zn-0.2Y and Mg-1.5Zn-0.8Y, as described in reference 8; and Mg-1.2Zn-0.79Gd and Mg-2.26Zn-0.74Gd, as described in reference 9.

1. Improved Rollability of the Alloys

The improved rollability of the alloys is demonstrated by comparing them to the conventional alloy AZ31B. In the first instance, the results from the TRC strips are presented followed by sand castings. All the rolling work was performed in a two-high rolling mill with un-heated rolls (rolls at room temperature).

1.1. TRC Strips 1.1.1. Conventional Alloy—AZ31B

The sheet dimensions, pre-rolling treatment and process parameters are detailed in Table 1. The roll settings for each pass and the sheet thickness after each pass, etc., are given in Table 2. As evident in the table, six passes were required to reduce 3 mm thick AZ31B strip to a final thickness of 0.73 mm.

The annealing temperature shown in Table 1 is used in practice. This annealing step could be performed at 200° C. for TRC strips.

TABLE 1

AZ31B strip and process details

| | |
|---|---|
| Sheet dimensions | 300 mm wide × 3 mm thick × 1000 mm length |
| Homogenisation temperature & time | 350° C., 16 hrs |
| Rolling temperature & roll speed | 420° C. (strip from the furnace), 7.07 m/min |
| Final thickness & no. of roll passes | 0.73 mm, 6 passes |
| Annealing temperature & time | 350° C., 1 hr |

TABLE 2

Hot rolling of TRC AZ31B at 420° C.

| Pass no. | Rolls gap setting, mm | Sheet thickness, mm | Percent reduction |
|---|---|---|---|
| 0 | | 3.07 | |
| 1 | −0.500 | 2.23 | 27 |
| 2 | +0.500 | 1.52 | 31 |
| 3 | +0.900 | 1.15 | 24 |
| 4 | +0.800 | 0.97 | 16 |
| 5 | +0.800 | 0.80 | 17 |
| 6 | +0.800 | 0.73 | 8 |

1.1.2. Mg-2Zn-0.3Y

Figure 2:
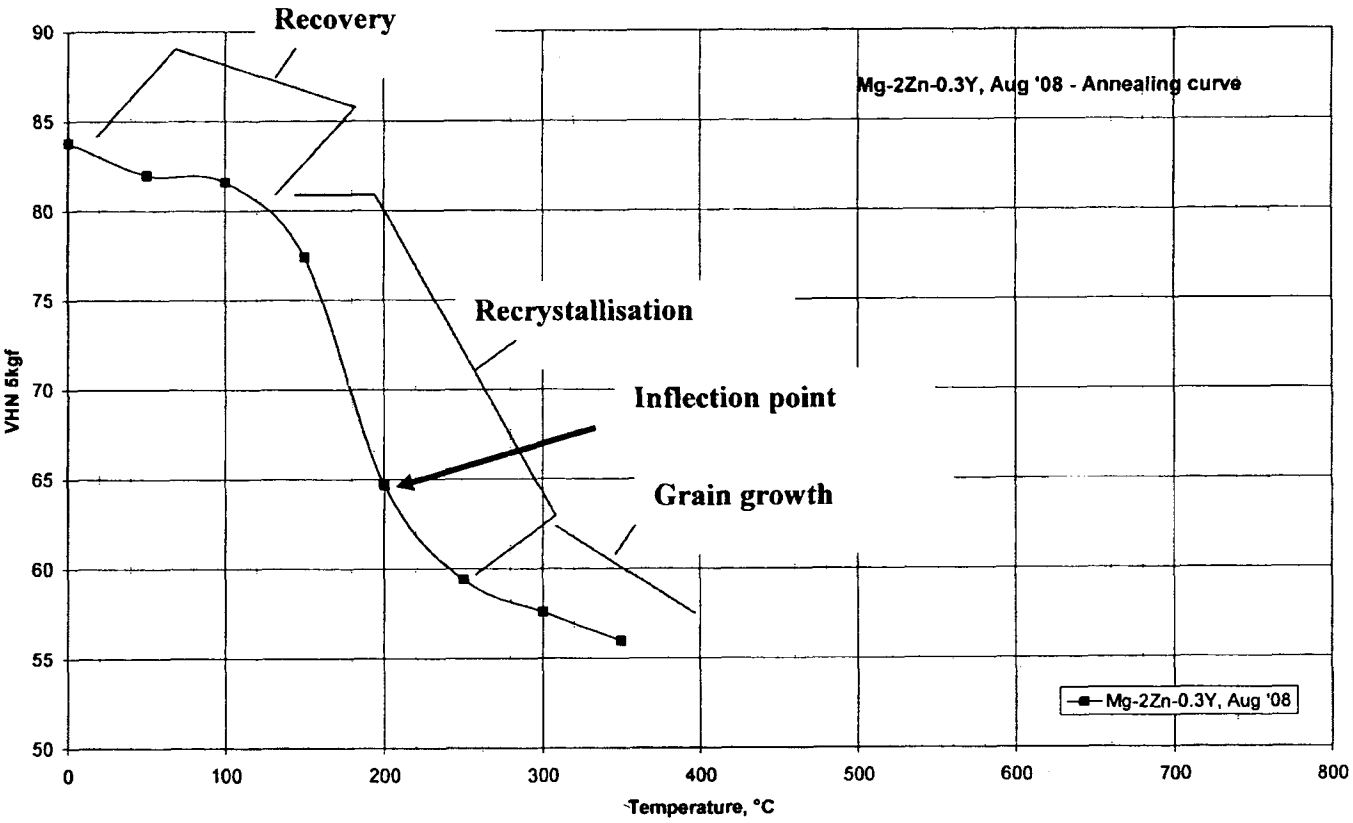
FIG. 2 is a graph identifying the inflection point of the hardness-annealing temperature curve for Mg-2Zn-0.3Y cast by TRC.

This alloy was rolled at two different temperatures, 420° C. and 350° C., to demonstrate that the alloy not only has improved rollability when compared to AZ31B but can also be rolled at a lower temperature. The sheet dimensions, pre-rolling treatment and process parameters are detailed in Table 3 and 5, respectively, for the two rolling temperatures. As evident from Table 4 and 6, that details the roll settings for each pass, sheet thickness after each pass, etc., only three passes are required to reduce the 3 mm thick strip to a final thickness of 0.74 mm or 0.77 mm, respectively. The annealing temperature in Table 3 and 5 is chosen from the annealing curve shown in FIG. 2. FIG. 2 depicts the three stages of an annealing heat treatment previously mentioned, those being recovery, re-crystallisation and grain growth 1.1.2.1. Hot Rolling at 420° C.

TABLE 3

Mg—2Zn—0.3Y strip and process details

| | |
|---|---|
| Sheet dimensions | 150 mm wide × 3 mm thick × 1000 mm length |
| Homogenisation temperature & time | 345° C., 2 hrs |
| Rolling temperature & roll speed | 420° C. (strip from the furnace), 7.07 m/min |
| Final thickness & no. of roll passes | 0.74 mm, 3 passes |
| Annealing temperature & time | 230° C., 1 hr |

TABLE 4

| Hot rolling of TRC Mg—2Zn—0.3Y at 420° C. | | | |
|---|---|---|---|
| Pass no. | Rolls gap setting, mm | Sheet thickness, mm | Percent reduction |
| 0 | | 2.97 | |
| 1 | −0.500 | 1.78 | 39 |
| 2 | +0.500 | 1.09 | 38.7 |
| 3 | +0.900 | 0.74 | 32 |

1.1.2.2. Hot Rolling at 350° C.

TABLE 5

| Mg—2Zn—0.3Y strip and process details | |
|---|---|
| Sheet dimensions | 150 mm wide × 3.11 mm thick × 1000 mm length |
| Homogenisation temperature & time | 345° C., 2 hrs |
| Rolling temperature & roll speed | 350° C. (strip from the furnace), 7.07 m/min |
| Final thickness & no. of roll passes | 0.77 mm, 3 passes |
| Annealing temperature & time | 230° C., 1 hr |

TABLE 6

| Hot rolling of TRC Mg—2Zn—0.3Y at 350° C. | | | |
|---|---|---|---|
| Pass no. | Rolls gap setting, mm | Sheet thickness, mm | Percent reduction |
| 0 | | 3.11 | |
| 1 | −0.500 | 1.88 | 39 |
| 2 | +0.500 | 1.14 | 39 |
| 3 | +0.900 | 0.77 | 32 |

1.1.3. Mg-2Zn-0.3Gd

The sheet dimensions, pre-rolling treatment and process parameters are detailed in Table 7 for this alloy. In this example the sheet thickness is about 1.2 mm more than that of AZ31B and Mg-2Zn-0.3Y presented above (or ~40%). As evident from Table 8 it took only six passes to roll this alloy strip from an initial thickness of 4.25 mm to a final thickness of 0.84 mm at a rolling temperature of 350° C. This confirms the superior rollability of the Mg-2Zn-0.3Gd alloy compared to AZ31B. The annealing temperature in Table 7 was chosen from the annealing curve shown in FIG. 3.

TABLE 7

| Mg—2Zn—0.3Gd strip and process details | |
|---|---|
| Sheet dimensions | 200 mm wide × 4.25 mm thick |
| Homogenisation temperature & time | 350° C., 2 hrs |
| Rolling temperature & roll speed | 350° C. (strip from the furnace), 7.07 m/min |
| Final thickness & no. of roll passes | 0.84 mm, 6 passes |
| Annealing temperature & time | 2.00° C., 1 hr |

TABLE 8

| Hot rolling of TRC Mg—2Zn—0.3Gd at 350° C. | | | |
|---|---|---|---|
| Pass no. | Rolls gap setting, mm | Sheet thickness, mm | Percent reduction |
| 0 | | 4.25 | |
| 1 | −2.100 | 3.25 | 23.5 |
| 2 | −1.300 | 2.55 | 21.5 |

TABLE 8-continued

| Hot rolling of TRC Mg—2Zn—0.3Gd at 350° C. | | | |
|---|---|---|---|
| Pass no. | Rolls gap setting, mm | Sheet thickness, mm | Percent reduction |
| 3 | −0.700 | 1.97 | 22.8 |
| 4 | −0.150 | 1.54 | 21.8 |
| 5 | +0.400 | 1.14 | 26.0 |
| 6 | +0.900 | 0.84 | 30.0 |

1.2 Sand Castings

Rollability of the sand castings of conventional alloy AZ31B and Mg-2Zn-0.3Gd are presented in this section. The slabs were initially rolled length wise and once the slab reached 300 mm, was rotated 90° and rolled until the final pass. This rotation is identified in the tables showing the rolling schedule as cross-rolled. As described before, higher homogenisation temperature and time as well as breakdown rolling is necessary for sand castings.

1.2.1. Conventional AZ31B

The slab dimensions and process variables are given in Table 9, while the rolling schedule is given in Table 10. A total of 11 passes was required to reduce the thickness of the slab from an initial thickness of 26 mm to a final thickness of 0.9 mm.

TABLE 9

| AZ31B slab and process details | |
|---|---|
| Slab dimensions after scalping | 115 mm wide × 26 mm thick × 195 mm length |
| Homogenisation temperature & time | 420° C., 24 hrs |
| Breakdown temperature & roll speed | 500° C. (slab from furnace), 7.07 m/min |
| Hot rolling temperature & roll speed | 420° C. (strip from the furnace), 7.07 m/min |
| Final thickness & no. of roll passes | 0.92 mm, 11 passes |
| Annealing temperature & time | 350° C., 1 hr |

TABLE 10

| Hot rolling of sand cast AZ31B | | | | |
|---|---|---|---|---|
| Rolling details | Pass no. | Rolls gap setting, mm | Sheet thickness, mm | Percent reduction |
| Break down rolling | 0 | | 26 | |
| | 1 | −23.0 | 22.8 | 12 |
| | 2 | −14.0 | 14.4 | 36.8 |
| | 3 | −8.0 | 8.6 | 40.3 |
| Cross-rolled | 4 | −4.8 | 6.0 | 30.2 |
| | 5 | −3.6 | 4.7 | 21.7 |
| | 6 | −2.8 | 3.8 | 19.2 |
| | 7 | −2.3 | 3.2 | 15.9 |

TABLE 10-continued

| Hot rolling of sand cast AZ31B | | | | |
|---|---|---|---|---|
| Rolling details | Pass no. | Rolls gap setting, mm | Sheet thickness, mm | Percent reduction |
| Hot rolling | 8 | −0.500 | 2.26 | 29.4 |
| | 9 | +0.500 | 1.58 | 30.1 |
| | 10 | +0.900 | 1.10 | 30.4 |
| | 11 | +0.800 | 0.92 | 16.4 |

1.2.2. Mg-2Zn-0.3Gd

The slab dimensions and process variables are given in Table 11, while the rolling schedule is given in Table 12. It took a total of 9 passes to reduce the thickness of the slab from an initial thickness of 26 mm to a final thickness of 0.9 mm. The reduction in the number of passes demonstrates the improved rollability of the Mg-2Zn-0.3Gd alloy. The annealing temperature is selected from the annealing curve shown in FIG. 4, established for the sand cast alloy.

TABLE 11

| Mg—2Zn—0.3Gd slab and process details | |
|---|---|
| Slab dimensions after scalping | 115 mm wide × 26 mm thick × 195 mm length |
| Homogenisation temperature & time | 8 hrs @ 350° C. followed by 16 hrs @ 420° C. |
| Breakdown temperature & roll speed | 500° C. (slab from furnace), 7.07 m/min |
| Hot rolling temperature & roll speed | 420° C. (strip from the furnace), 7.07 m/min |
| Final thickness & no. of roll passes | 0.88 mm, 9 passes |
| Annealing temperature & time | 300° C., 1 hr |

TABLE 12

| Hot rolling of sand cast Mg—2Zn—0.3Gd | | | | |
|---|---|---|---|---|
| Rolling details | Pass no. | Rolls gap setting, mm | Sheet thickness, mm | Percent reduction |
| Break down rolling | 0 | | 26.0 | |
| | 1 | −14.0 | 14.7 | 43.5 |
| | 2 | −7.3 | 8.2 | 44.2 |

TABLE 12-continued

| Hot rolling of sand cast Mg—2Zn—0.3Gd | | | | |
|---|---|---|---|---|
| Rolling details | Pass no. | Rolls gap setting, mm | Sheet thickness, mm | Percent reduction |
| Cross-rolled | 3 | −4.1 | 5.3 | 35.4 |
| | 4 | −2.7 | 3.8 | 28.3 |
| | 5 | −1.9 | 2.9 | 23.7 |
| Hot rolling | 6 | −0.500 | 2.1 | 27.6 |
| | 7 | +0.500 | 1.5 | 28.6 |
| | 8 | +0.900 | 1.1 | 26.7 |
| | 9 | +0.800 | 0.9 | 18.2 |

2. Tensile Properties of the Alloys

Tensile properties of the rolled and annealed sheets (the finished product) at room temperature were measured using a screw driven Instron tensile testing machine. Tensile specimens from both the longitudinal, direction (also referred to as rolling direction or 0° orientation) and transverse direction (90° to the rolling direction or 90° orientation) were punched from the sheet for testing. The specimens were 6 mm wide and the gauge length was 25 mm. The results for the alloys are the average of six samples tested for each case.

In magnesium alloys the basal planes of the HCP crystal structure tends to orient approximately parallel to the surface during rolling. A sheet with this preferred orientation will have the tensile properties higher in the 90° orientation compared to 0° orientation.

2.1. Conventional Alloy—AZ31B

Tensile properties of TRC and sand cast AZ31B is shown in Table 13. As expected for magnesium alloys the tensile properties of the specimens, especially the proof stress and the ultimate tensile stress, from the 0° orientation is lower than that of the specimens from the 90° orientation. The table also shows the tensile properties of the TRC AZ31B after annealing at the optimum temperature of 200° C. for 1 hr (highlighted with an astrix). The tensile properties are certainly, higher than that achieved after annealing at 350° C.

TABLE 13

| | 0° orientation | | | 90° orientation | | |
|---|---|---|---|---|---|---|
| Casting | 0.2% PS, MPa | UTS, MPa | % E | 0.2% PS, MPa | UTS, MPa | % E |
| TRC A@350° C. | 156.8 ± 4.5 | 256.9 ± 2.7 | 16.0 ± 0.9 | 184.6 ± 1.0 | 261.2 ± 3.8 | 10.7 ± 1.5 |
| SC A@350° C. | 142.1 ± 3.5 | 246.6 ± 5.7 | 18.1 ± 3.2 | 164.0 ± 4.4 | 256.3 ± 4.7 | 16.6 ± 1.8 |
| TRC* A@200° C. | 188.5 ± 2.7 | 267.5 ± 5.3 | 16.0 ± 2.0 | 208.5 ± 2.8 | 268.9 ± 6.2 | 11.9 ± 3.3 |

Tensile properties of AZ31B; TRC—twin-roll casting; SC—sand casting; PS—Proof Stress; UTS—Ultimate Tensile Stress; % E—Percentage Elongation 2.2. Mg-2Zn-0.3Y Tensile properties of the TRC Mg-2Zn-0.3Y are presented in Table 14 along with the properties of two similar alloys published in the literature. As expected the proof stress and ultimate tensile stress of the specimens from the 0° orientation is lower than that of the specimens from the 90° orientation for the TRC sheet, while this is not the case for the two alloys in the published literature. The proof stress of these alloys is higher for the specimens from the 0° orientation compared to the specimens from the 90° orientation. Similar results were observed for the TRC sheet as shown in Table 15.

However, by carefully choosing the process conditions, especially the homogenisation temperature and rolling temperature, it was possible to achieve higher proof stress on both orientations. This is very important as a sheet supplier because when an end user specifies a minimum proof stress, it is expected that the sheet meets that minimum value in all the orientations.

TABLE 14

| | 0° orientation | | | 90° orientation | | |
|---|---|---|---|---|---|---|
| Casting | 0.2% PS, MPa | UTS, MPa | % E | 0.2% PS, MPa | UTS, MPa | % E |
| TRC | 175.4 ± 1.9 | 236.1 ± 1.3 | 23.3 ± 2.3 | 183.3 ± 2.8 | 239.3 ± 2.3 | 17.6 ± 2.0 |
| Mg—1.5Zn—0.2Y[8] [PM & E] | 139 | 222 | 23 | 97 | 218 | 30 |
| Mg—1.5Zn—0.8Y[8] [PM & E] | 178 | 225 | 18 | 144 | 229 | 21 |

Tensile properties of Mg—2Zn—0.3Y; TRC—twin-roll casting; PM—permanent mould casting; E—extrusion; PS—Proof Stress; UTS—Ultimate Tensile Stress; % E—Percentage Elongation

TABLE 15

| | 0° orientation | | | 90° orientation | | |
|---|---|---|---|---|---|---|
| TRC - process conditions | 0.2% PS, MPa | UTS, MPa | % E | 0.2% PS, MPa | UTS, MPa | % E |
| As cast | 190.2 ± 1.9 | 246.4 ± 0.8 | 17.5 ± 3.1 | 145.2 ± 2.0 | 220.8 ± 8.3 | 16.8 ± 5.1 |
| HR@420° C. A@230° C./1 h | | | | | | |
| H@345° C./2 h | 186.1 ± 3.2 | 242.6 ± 3.9 | 18.6 ± 2.4 | 151.4 ± 1.2 | 220.6 ± 6.4 | 15.8 ± 4.4 |
| HR@420° C. A@230° C./1 h | | | | | | |
| H@345° C./2 h | 173.6 ± 1.9 | 230.9 ± 1.3 | 18.3 ± 2.5 | 184.1 ± 2.1 | 230.2 ± 8.3 | 13.3 ± 1.1 |
| HR@350° C. A@230° C./1 h | | | | | | |

Tensile properties of Mg—2Zn—0.3Y; TRC—twin-roll casting; PS—Proof Stress; UTS—Ultimate Tensile Stress; % E—Percentage Elongation; H—homogenised; HR—hot rolled; A—annealed; h—hour 2.3. Mg-2Zn-0.3Gd Tensile properties from specimens taken from the TRC and sand cast sheets are shown in Table 16 along with the properties of two similar alloys published in the literature. The proof stress and ultimate tensile strength of the specimens from the 90° orientation is higher than that of the specimens from the 0° orientation. This was not the case with the alloys published in the literature. As described in the section for Mg-2Zn-0.3Y alloy, by carefully choosing the homogenisation and rolling temperatures it was possible to achieve higher values for both orientations.

TABLE 16

| | 0° orientation | | | 90° orientation | | |
|---|---|---|---|---|---|---|
| Casting | 0.2% PS, MPa | UTS, MPa | % E | 0.2% PS, MPa | UTS, MPa | % E |
| TRC | 174.5 ± 1.8 | 234.7 ± 1.1 | 24.5 ± 0.5 | 196.4 ± 1.4 | 243.0 ± 1.7 | 19.4 ± 3.0 |
| SC | 143.0 ± 3.1 | 250.4 ± 1.2 | 18.8 ± 1.4 | 163.8 ± 1.4 | 256.4 ± 3.9 | 16.7 ± 2.3 |
| Mg—1.2Zn—0.79Gd [PM] | 181.5 | 231.6 | 29.2 | 144.9 | 240.1 | 28.4 |
| Mg—2.26Zn—0.74Gd [PM] | 188.9 | 232.7 | 27.2 | 123.5 | 230.4 | 35.2 |

Tensile properties of Mg—2Zn—0.3Gd; TRC—twin-roll casting; SC—sand casting; PM—permanent mould; PS—Proof Stress; UTS—Ultimate Tensile Stress; % E—Percentage Elongation.

2.4. Comparative Tensile Properties of Mg—Zn—Gd Alloys with Varying Compositions Tensile properties, in three orientations, from specimens taken from the TRC are shown in Table 17 along with their respective percentage elongation. The proof stress and ultimate tensile strength of the specimens from the 90° orientation are higher than that of the specimens from the 0° orientation, except for the Mg-1Zn-0.65Gd alloy.

TABLE 17

Tensile properties of Mg—Zn—Gd twin roll cast alloy sheet, H@350° C./2 hrs, HR@ 350° C., A @ 200° C./1 hr

| | 0° orientation | | | 45° to the rolling direction | | | 90° orientation | | |
|---|---|---|---|---|---|---|---|---|---|
| Alloy | 0.2% PS, MPa | UTS, MPa | % E | 0.2% PS, MPa | UTS, MPa | % E | 0.2% PS, MPa | UTS, MPa | % E |
| Mg—2Zn | 164.8 ± 1.3 | 228.2 ± 2.0 | 24.0 ± 4.4 | 161.9 ± 2.8 | 229.8 ± 2.5 | 23.9 ± 0.8 | 185.3 ± 2.5 | 237.3 ± 2.9 | 18.2 ± 1.9 |
| Mg—1Zn—0.1Gd | 179.5 ± 1.6 | 218.3 ± 1.6 | 22.8 ± 1.4 | 192.6 ± 2.0 | 222.9 ± 2.3 | 22.7 ± 2.6 | 215.6 ± 3.0 | 232.4 ± 1.8 | 20.6 ± 3.0 |
| Mg—1Zn—0.65Gd | 260.8 ± 4.5 | 277.1 ± 2.0 | 11.1 ± 1.3 | 221.5 ± 5.4 | 246.6 ± 2.3 | 21.2 ± 4.3 | 203.8 ± 4.4 | 251.8 ± 1.4 | 14.5 ± 1.7 |
| Mg—1.63Zn—0.43Gd | 188.4 ± 2.2 | 237.8 ± 2.0 | 24.9 ± 3.1 | 187.4 ± 1.5 | 234.3 ± 1.1 | 23.2 ± 0.7 | 210.5 ± 1.3 | 248.3 ± 2.1 | 21.4 ± 2.1 |
| Mg—1.89Zn—0.11Gd | 185.7 ± 1.8 | 232.7 ± 1.3 | 23.6 ± 2.8 | 195.4 ± 1.3 | 236.0 ± 2.9 | 19.3 ± 3.7 | 185.8 ± 2.2 | 232.5 ± 1.8 | 22.5 ± 2.8 |
| Mg—1.89Zn—0.34Gd | 174.5 ± 1.8 | 234.7 ± 1.1 | 24.5 ± 0.5 | 179.6 ± 2.4 | 228.2 ± 3.7 | 13.1 ± 1.8 | 196.4 ± 1.4 | 243.0 ± 1.7 | 19.4 ± 3.0 |
| Mg—2.28Zn—0.16Gd | 201.2 ± 2.1 | 237.0 ± 1.5 | 17.1 ± 3.1 | 209.7 ± 3.5 | 236.6 ± 3.1 | 23.5 ± 2.9 | 227.5 ± 3.7 | 247.9 ± 2.9 | 20.6 ± 4.3 |
| Mg—2.17Zn—0.54Gd | 187.0 ± 3.5 | 237.3 ± 4.1 | 25.3 ± 1.9 | 184.3 ± 2.3 | 230.3 ± 2.7 | 28.9 ± 2.2 | 193.4 ± 4.6 | 244.3 ± 2.1 | 22.7 ± 2.1 |
| Mg—2.94Zn—0.55Gd | 201.8 ± 1.6 | 255.1 ± 1.9 | 20.8 ± 1.9 | 216.9 ± 1.6 | 251.5 ± 5.3 | 9.1 ± 2.8 | 205.0 ± 1.5 | 253.6 ± 2.6 | 21.1 ± 3.4 |
| AZ31B | 156.8 ± 4.5 | 256.9 ± 2.7 | 16.0 ± 0.9 | | | | 184.6 ± 1.0 | 261.2 ± 3.8 | 10.7 ± 1.5 |

Tensile Properties of Mg—Zn—Gd alloys with varying compositios; TRC—twin-roll casting; PS—Proof Stress; UTS—Ultimate Tensile Stress; % E—Percentage Elongation; H—homogenised; HR—hot rolled; A—annealed; h—hour 3. Formability of the Alloys A series of tests were undertaken to ascertain the degree of formability of TRC Mg-2Zn-0.3Y and TRC Mg-2Zn-0.3Gd with TRC AZ31B as a reference material. Formability or workability is defined as the amount of deformation that can be given to a specimen without fracture in a given process. The tests, referred to below, included a swift cup test for deep drawing and an Erichsen test to measure the stretch formability of the respective sheet metal.

3.1. Swift Cup Test for Deep Drawing

Deep drawing tests using the hot rolled and annealed sheets of Mg-2Zn-0.3Y, Mg-2Zn-0.3Gd and AZ31B were performed using a 40 mm flat bottom punch. Two sizes of discs were cut from the sheet (100 mm and 82 mm in diameters) to achieve a limiting draw ratio (LDR) of 2.5 and 2.05.

The tests commenced using the 100 mm disc with a die temperature of 225° C. If the draw was successful, the next sample was drawn at 25° C. lower than the last draw and the process repeated. If, however, the draw was unsuccessful, the temperature was raised by 10° C. and tried again until the lowest temperature at which the disc could be drawn successfully was established. The 82 mm disc was then used and the process above repeated until the lowest temperature at which the 82 mm disc could be successfully drawn was identified. The results from the deep drawing test are shown in Table 18.

TABLE 18

Deep drawing tests for three alloys at an LDR of 2.5 and 2.05.

| Alloy | LDR 2.5 | LDR 2.05 |
|---|---|---|
| AZ31B | 225° C. | 175° C. |
| Mg—2Zn—0.3Y | 160° C. | 160° C. |
| Mg—2Zn—0.3Gd | 160° C. | 135° C. |

As shown from the test results, the alloys in accordance with various embodiments of the invention can be deep drawn at lower temperatures than that required for AZ31B. For the limiting draw ratio (LDR) of 2.05, the lowest temperature at which the yttrium containing alloy can be successfully deep drawn was 160° C., while for the gadolinium containing alloy it was 135° C. Both these temperatures are lower than that required for AZ31B, which could be deep drawn only at 175° C. for the same LDR.

3.2. Erichsen Tests

Erichsen tests were performed on the hot rolled annealed sheets of Mg-2Zn-0.3Y, Mg-2Zn-0.3Gd and AZ31B using a hemispherical punch (20 mm diameter) at room temperature. The respective sheets were clamped and the punch was pushed against the sheet until the sheet cracked. The height of the resulting dome on the sheet is the Erichsen value, which is a measure of the stretch formability of the sheet. The higher the Erichsen value, the better the response of the sheet to stretch formability. The Erichsen values achieved for TRC AZ31B, Mg-2Zn-0.3Y and Mg-2Zn-0.3Gd at room temperature were 3.6, 8.5 and 6.3, respectively.

The results confirm that the alloys in accordance with several embodiments also exhibit good stretch formability at room temperature. The Erichsen values for each of the two embodiments of the invention exhibit significantly higher values than that returned from the AZ31B sample.

4. Corrosion Resistance—Salt Immersion Test

Corrosion resistance of the alloys was tested using TRC AZ31B as the reference material. Three samples each from the hot rolled annealed sheets of TRC AZ31B, Mg-2Zn-0.3Y and Mg-2Zn-0.3Gd were immersed in a non-aerated solution containing 3.5 wt. % NaCl for 7 days. The respective samples were weighed before and after the immersion process. From weight loss measurements, the corrosion rate was calculated and expressed as a weight ratio to eliminate differences in the sample dimensions. The weight ratio achieved for TRC AZ31B, Mg-2Zn-0.3Y and Mg-2Zn-0.3Gd were 0.007, 0.038 and 0.0083, respectively.

The alloy containing gadolinium as the alloying element, exhibited a corrosion resistance comparable with AZ31B (0.0083, expressed as weight ratio, compared to 0.007). The alloy containing yttrium as the alloying element was an order of magnitude higher.

5. Cost Advantages

Advantageously, the cost of alloys of the described embodiments were comparable with that of AZ31B ingots (based on the cost of alloying elements as of May 2009). Furthermore, alloys characterised in accordance with the embodiments are able to be deep drawn at significantly lower temperatures whilst exhibiting a good degree of stretch formability at room temperature. Furthermore, the alloys in accordance with the embodiments generally exhibit good ductility and rolling workability that equates to 50% less number of rolling passes compared to the commercially known wrought magnesium alloy, AZ31B. Moreover products formed from alloy sheeting exhibit comparable corrosion properties to products formed from AZ31B.

The alloy, at least in accordance with the above mentioned embodiments is well suited for room temperature applications within the electronic and automotive industries, similar to AZ31B.

It will be appreciated by persons skilled in the art that numerous variations and/or modifications may be made to the described embodiments and examples without departing from the scope of the invention as broadly described. The described embodiments are, therefore, to be considered in all respects as illustrative and not restrictive.

REFERENCES

1. E. F. Emley, Principles of Magnesium Technology, (Oxford, London: Pergamon Press Ltd., 1966), 452-583.
2. F. Pravdic, C. Wagerer and G. Traxler, "The Vertical Direct Chill Casting Technology for Magnesium Alloys—Including Safety Concepts and Product Quality", METEC Congress '03, Düsseldorf, Germany, 2003.
3. F. Pravdic, et. al., "Vertical Direct Chill (VDC) Casting of Magnesium—Optimized Casting Parameters and Safety Issues", in Magnesium: Proceedings of the 6$^{th}$ International Conference Mg alloys and their applications 2003, eds. K. U. Kainer (Wolfsburg, Germany: Wiley-VCH Verlag GmbH & Co., KGaA, 2004), 675-680.
4. ASM Speciality Handbook—Magnesium and Magnesium Alloys, (Materials Park, Ohio, USA:ASM International, 1999), 85-89.
5. Phase Diagrams of Binary Magnesium Alloys, eds. A. A. Nayeb-Hashemi and J. B. Clark, (Metals Park, Ohio, USA: ASM International, 1988).
6. R. G. Wilkinson and F. A. Fox, "The Hot Working of Magnesium and its Alloys", Journal of Institute of Metals, 76, (1950), 473-500.
7. C. R. Brooks, Heat Treatment, Structure and Properties of Nonferrous Alloys, (Metals Park, Ohio, USA: ASM, 1982), 21-49.
8. Y. Chino, et. al, "Texture and Stretch formability of a rolled Mg—Zn alloy containing dilute content of Y", Materials Science and Engineering A 513-514 (2009) 394-400.
9. H. Yan, et. al., "Room-temperature ductility and anisotropy of two rolled Mg—Zn—Gd alloys", Materials Science and Engineering A 527 (2010) 3317-3322;

The invention claimed is:

1. A twin-roll cast magnesium-based alloy with a crystalline structure for wrought applications consisting of:

0.5 to 4.0% by weight zinc;

0.1 to 0.65% by weight gadolinium; and the remainder being magnesium except for incidental impurities selected from Mn, Fe, Cu, Ni, Al or Si, wherein the total weight of the incidental impurities is less than 0.5% by total weight of the alloy, and wherein the alloy has a 0.2% proof stress of 174.5 MPa±1.8 MPa to 260.8±5.5 MPa in a 0° orientation, a 0.2% proof stress of at least 179.6 MPa±2.4 MPa to 221.5±5.4 MPa in a 45° orientation, and a 0.2% proof stress of at least 185.8 MPa±2.2 MPa to 227.5±3.7 MPa in a 90° orientation.

2. The alloy according to claim 1, wherein the weight of zinc is 1.0 to 3.0%.

3. The alloy according to claim 1, wherein the alloy is suitable for drawing at a temperature of around 135° C. to achieve a limiting draw ratio of 2.05.

* * * * *